United States Patent [19]

Sackett

[11] 4,095,906

[45] Jun. 20, 1978

[54] WRITING INSTRUMENT

[76] Inventor: Marvin Elmer Sackett, 5430-A Garfield Ave., Sacramento, Calif. 95841

[21] Appl. No.: 714,852

[22] Filed: Aug. 16, 1976

[51] Int. Cl.[2] ..... A46B 11/00; A46B 17/08

[52] U.S. Cl. ..... 401/48

[58] Field of Search ..... 401/48, 6–8, 401/131

[56] References Cited

U.S. PATENT DOCUMENTS

| | | | |
|---|---|---|---|
| 724,687 | 4/1903 | Floren | 401/48 |
| 1,848,605 | 3/1932 | Conway | 401/48 |
| 2,245,116 | 6/1941 | Rhatigan | 401/48 |
| 2,362,992 | 11/1944 | Dentiler, Jr. | 401/48 |
| 2,497,418 | 2/1950 | Schroeder, Jr. | 401/48 |

FOREIGN PATENT DOCUMENTS

| | | | |
|---|---|---|---|
| 76,124 | 4/1919 | Germany | 401/48 |

*Primary Examiner*—Stephen C. Pellegrino
*Attorney, Agent, or Firm*—Clarence M. Crews

[57] ABSTRACT

A writing device adapted for use by a handicapped person comprises a lower body member formed with a broad, smooth bottom surface adapted to glide over the surface to be written upon, and a writing instrument carrier hingedly mounted thereon and normally biased yieldingly to hold the writing instrument a short distance away from the device supporting, writing surface, so that a slight downward pressure upon said carrier member causes the writing instrument to contact the surface to be written upon.

2 Claims, 3 Drawing Figures

WRITING INSTRUMENT

BACKGROUND OF THE INVENTION

Persons with arthritis, palsy and other impediments find it difficult and sometimes impossible to grip an ordinary pen, pencil or other scribing instrument. Consequently, they are unable to write simple letters and sometimes cannot even sign their names.

BRIEF DESCRIPTION OF THE INVENTION

The present invention is described in Disclosure Document number 046204 which was filed Jan. 22, 1976.

The apparatus contemplated by this invention is a holder for a scribing instrument or stylus such as a pen or pencil.

The apparatus has a body which is usually made in two parts that are spring-biased apart. The upper body holds the writing stylus or scribing instrument. The lower body is contoured and shaped to slide over the surface to be written upon. A slight downward pressure of the hand of the user upon the upper body causes the scribing instrument to contact the surface to be written upon, and the spring biases the scribing instrument off of that surface when such pressure is withdrawn.

The scribing instrument may be attached to the upper body by providing a recess particularly shaped to receive a conventional pen.

In a preferred embodiment, the pen is made integral with the upper body, and the upper body contains the ink supply.

In still another preferred embodiment, the body is made sufficiently slim to fit into a user's pocket, and the stylus folds into the body.

In some of the embodiments, the upper and lower body are hinged together.

The lower body is contoured, in profile, in a pear-shaped contour. The large part of the lower body may easily be grasped by the user while the smaller part of that body allows the user to see what he is writing. The pen makes a good desk pen for normal users.

It is therefore an object of this invention to provide a writing instrument which can easily be used by persons with crippled or weak hands and which facilitates writing by persons with normal hands.

It is a further object of this invention to provide a novel writing or scribing instrument which may, for example, be used to control a pen, pencil, paint brush or other stylus.

It is a more specific object of this invention to provide an easily graspable body which carries or is adapted to carry a stylus, the body being contoured to be shoved or glided over a writing surface with the stylus in contact with the writing surface.

BRIEF DESCRIPTION OF DRAWINGS

Other objects will become apparent from the following description, taken together with the accompanying drawings, in which:

FIGS. 1 to 3 show a practical and advantageous embodiment of the invention. A body 30 has a pear-shaped lower portion 32 which has a smooth gliding bottom surface 34 contoured to match the flat writing surface 14. A top portion 36 is hinged at the rear end by a hinge 38 to the lower portion 32. The hinge may be merely a dowel or pin in a journal. The upper portion 36 is biased upward by a leaf spring 40 as shown, for example, in FIGS. 2 and 3. The tip of the pen extends beyond the members 32 and 36 where it can be seen by the user.

Figure 1:
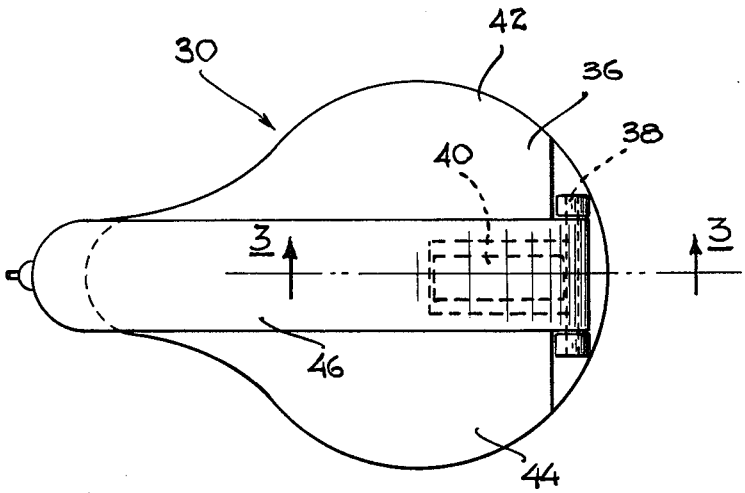
FIG. 1 is a top view of a second embodiment of the invention having an integral stylus, a body of two parts hinged together, and a leaf spring biasing the two body parts away from each other.
Figure 2:
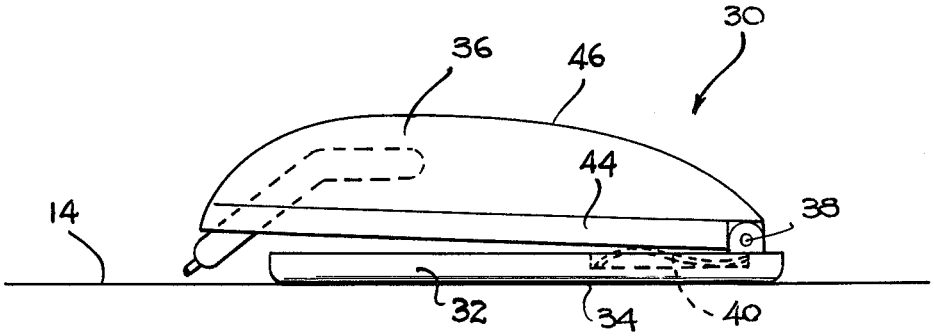
FIG. 2 is a side view of the apparatus of FIG. 1.
Figure 3:
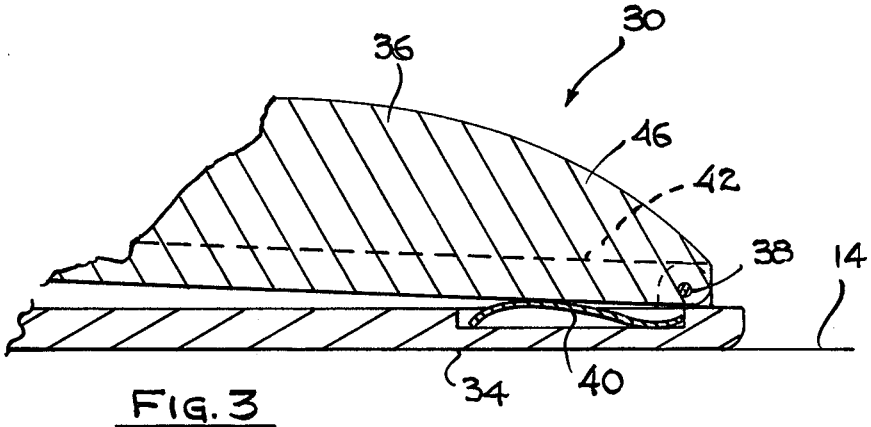
FIG. 3 is a sectional view, taken at 7—7, of FIG. 1.

The upper body 36 is contoured to have two flanges or wings 42,44 and an upstanding ridge 46 extending along its length. The upstanding ridge holds a stylus or pen which may include an ink supply (not shown). The stylus is pointing toward the writing surface 14 but is normally held off of the surface by the spring 40 so that unsightly blots are avoided. On the forward end of the apparatus the flanges 42,44 curve or taper toward the ridge 46 so that the writer can see what is being written.

The stylus can be replaced. Alternatively, the entire upper body portion can be replaced.

The instrument may be made out of metal, wood, plastics or other solid material. It may be made sufficiently inexpensively that the entire instrument may be thrown away when the ink supply fails.

Typically the width of the rearward part of the instrument body is about two-thirds of the length of the instrument. Also typically the length of the enlarged width portion is about the same as the width of that portion. The remaining length is narrowed so that the user may see the region of the stylus or pen point as writing occurs. The raised or upstanding portion is to facilitate grasping of the instrument and frequently to enclose the pen.

Although the apparatus has been described in detail above, it is not intended that the invention shall be limited by that description, but only in accordance with that description together with the substance of the appended claims.:

I claim:

1. A writing instrument for writing on paper and the like that presents a flat, smooth writing surface, said instrument comprising:

a pear-shaped paper engaging body having a wide rear portion and a narrow forward neck portion;

a stylus positioned within said neck portion and angled downward at an acute angle from the vertical, said stylus having its point substantially in the plane of the bottom surface of said body, the pear-shaped body having a lower portion for sliding upon a writing surface and an upper portion for carrying said stylus;

spring means between said upper and lower portions for biasing said lower and upper portions away from each other;

said spring means comprising a leafed spring between said upper and lower portions;

and further comprising a substantially horizontal pivot between said upper and lower portions and positioned upon the rearward end of said body.

2. A writing instrumentality comprising (a) a lower body member having a smooth, glidable under-surface, said member having a broad rear portion for stability and a relatively narrow forward portion for affording a clear view of the writing surface, (b) a comparatively narrow, stylus carrying upper body member constructed and arranged to carry a stylus engageable with the writing surface beyond the forward ends of both body members, (c) means hingedly connecting the rear end of the upper body member to the rear end of the lower member, and (d) a spring lightly interposed between the body members for causing the upper body member normally to maintain the stylus slightly out of engagement with the writing surface.

* * * * *